US005918954A

United States Patent [19]

Papadakis et al.

[11] Patent Number: 5,918,954

[45] Date of Patent: Jul. 6, 1999

[54] LIMITED ACCESS SALES APPARATUS

[75] Inventors: Chris Papadakis, Jamaica Estates; Eric Nelson, Glen Cove; Michael Keshner, Merrick, all of N.Y.

[73] Assignee: Philip Morris Incorporated, New York, N.Y.

[21] Appl. No.: 08/964,740

[22] Filed: Nov. 5, 1997

[51] Int. Cl.[6] ..... A47F 3/14

[52] U.S. Cl. ..... 312/126; 312/132; 312/265.5

[58] Field of Search ..... 312/126, 128, 312/132, 263, 140, 265.5, 234.4, 234.5, 71; 211/51, 59.3, 59.4

[56] References Cited

U.S. PATENT DOCUMENTS

| | | | |
|---|---|---|---|
| D. 60,083 | 12/1921 | Burns . | |
| D. 76,297 | 9/1928 | Geyer . | |
| D. 97,725 | 12/1935 | Botham . | |
| D. 154,677 | 8/1949 | Hawkins . | |
| D. 176,432 | 12/1955 | Smith . | |
| D. 202,058 | 8/1965 | D'Amato . | |
| D. 204,044 | 3/1966 | Bayly . | |
| D. 250,789 | 1/1979 | Mergenthaler . | |
| D. 254,821 | 4/1980 | Rabas . | |
| D. 328,958 | 8/1992 | Bragin et al. . | |
| 785,591 | 3/1905 | Conez | 312/128 |
| 1,525,206 | 2/1925 | Schwen | 312/126 |
| 1,626,013 | 4/1927 | Sherer | 312/126 X |
| 2,014,516 | 9/1935 | Beddingfield | 312/126 X |
| 2,635,029 | 4/1953 | Fokakis . | |
| 2,758,193 | 8/1956 | Mantopel | 312/126 X |
| 3,357,597 | 12/1967 | Groff . | |
| 3,858,757 | 1/1975 | Langdon, Jr. . | |
| 4,123,128 | 10/1978 | Abele | 312/132 X |
| 4,494,658 | 1/1985 | Simon et al. . | |
| 4,537,316 | 8/1985 | Simon . | |
| 4,730,741 | 3/1988 | Jackle, III et al. | 211/59.3 |
| 4,742,936 | 5/1988 | Rein . | |
| 4,796,763 | 1/1989 | Franklin et al. . | |
| 4,887,737 | 12/1989 | Adenau | 312/71 X |
| 5,040,674 | 8/1991 | Bragin et al. . | |
| 5,137,340 | 8/1992 | Cugley et al. | 312/234.5 |
| 5,240,126 | 8/1993 | Foster et al. | 211/59.3 |
| 5,450,969 | 9/1995 | Johnson et al. | 211/59.3 |
| 5,605,237 | 2/1997 | Richardson et al. | 211/59.3 |

FOREIGN PATENT DOCUMENTS

| | | | |
|---|---|---|---|
| 405317142 | 12/1993 | Japan | 312/132 |

*Primary Examiner*—Peter M. Cuomo
*Assistant Examiner*—Hanh V. Tran
*Attorney, Agent, or Firm*—Burns, Doane, Swecker & Mathis, L.L.P.

[57] ABSTRACT

A sales apparatus for packages having at least one storage shelf having a bottom surface including a plurality of peripheral edges and a plurality of side walls extending upwardly from the bottom surface. The plurality of side walls define an interior area of the storage shelf. An upper element defines a top surface. The at least one storage shelf includes a peripheral storage row adjacent to at least one of the side walls for displaying packages and at least one dispensing row disposed within the interior area of the storage shelf for dispensing packages. The side walls may be either transparent or opaque. A plurality of storage shelves may be stacked in order to increase the capacity of the sales apparatus.

26 Claims, 5 Drawing Sheets

LIMITED ACCESS SALES APPARATUS

TECHNICAL FIELD

The present invention is directed to a sales apparatus for packages or cartons, and more particularly, to a merchandising sales apparatus having limited access to the packages or cartons stored therein.

BACKGROUND OF THE INVENTION

Small packages or cartons of certain products, such as cigarettes for example, are generally displayed in self-service racks or rows which extend either horizontally or vertically. These types of merchandising displays are generally located in a check-out line of a supermarket or near the check-out counter of a convenience store. As shown in U.S. Pat. No. 4,537,316, for example, trays having a plurality of adjacent horizontal rows are disposed in a vertical arrangement along with a sign holder for advertising the product to be displayed for sale. While the self-service operation of such displays may lessen the involvement of store personnel in the direct sales of the product, it also increases the accessibility of the product, such as cigarettes, to potential shoplifters.

To overcome the susceptibility of the openly displayed product to theft or unqualified customers, recent trends have included merchandising display cases which are maintained under lock and key. These types of display cases allow the manufacturer to fully display their packaged product as well as any advertising messages. The purchase of the displayed products, however, requires store personnel to interrupt their current activity in order to unlock the display case and remove a packaged product for the customer. This process is not only burdensome on store personnel, but may greatly irritate the impatient customer who must first find a store clerk to assist them and then wait for the display case to be unlocked.

A further alternative to the locked display case includes behind-the-counter stocking of the packaged product. In this situation, the products are readily available to store personnel when requested by a customer. Significant merchandising opportunities may be lost, however, if the merchandise is removed from the immediate transactional area.

Therefore, a need exists for a display case capable of limiting the susceptibility of the packaged product to theft while maximizing merchandising opportunities.

SUMMARY OF THE INVENTION

In order to overcome the disadvantages of the various prior art systems, while still providing the benefits thereof, the present invention is directed to a sales apparatus for packages having at least one storage shelf with a bottom surface including a plurality of peripheral edges, a plurality of side walls extending upwardly from the bottom surface, and an upper element defining a top surface of the sales apparatus. The plurality of side walls define an interior area of the storage shelf which is used for storing or displaying and dispensing the packaged product to be sold. Each storage shelf includes a peripheral display row adjacent to at least one of the side walls for displaying packages and at least one dispensing row disposed within the interior area of the display shelf for dispensing packages.

In a further aspect of the present invention, the sales apparatus includes a bottom support member, a plurality of side walls extending upwardly from the bottom support member, at least one shelf for storing a plurality of packages, and an upper element defining a top surface. At least two of the side walls include a mechanism for supporting the shelf and an access opening to the plurality of packages stored on the at least one shelf is defined between two of the plurality of side walls. The apparatus may be stackable, both vertically or horizontally, The topmost unit may preferably be peaked. In a preferred embodiment, the apparatus may be springloaded such that sales personnel do not have to reach into the deepest recesses of the apparatus to retrieve product.

BRIEF DESCRIPTION OF THE DRAWINGS

These, and other, objects, features and advantages of the present invention will become more readily apparent to those skilled in the art upon reading the following detailed description, in conjunction with the appended drawings, in which.

DETAILED DESCRIPTION OF THE PREFERRED EMBODIMENTS

Figure 1:
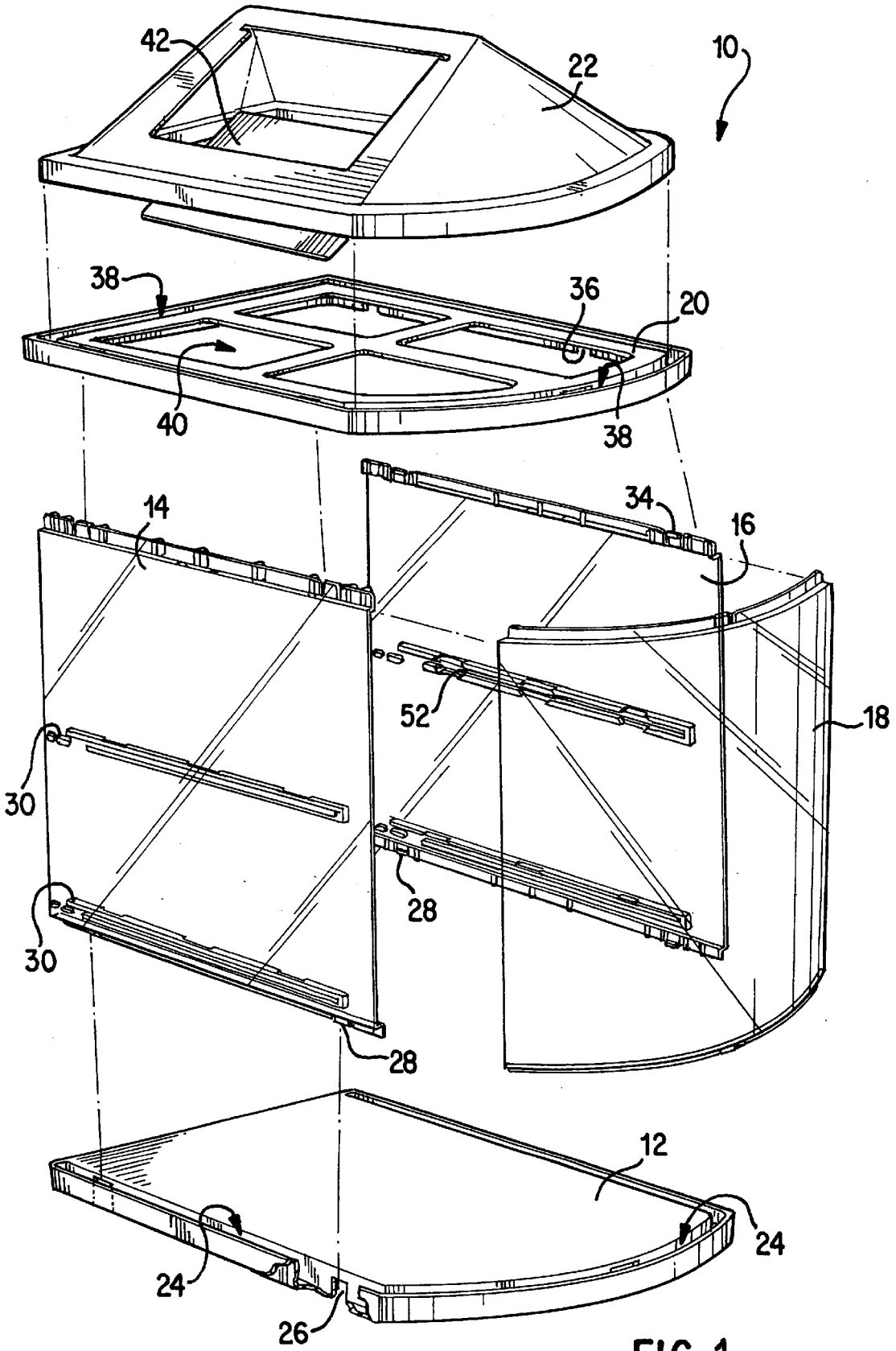
FIG. 1 is an exploded perspective view of a limited access sales apparatus in accordance with the present invention.
Figure 2:
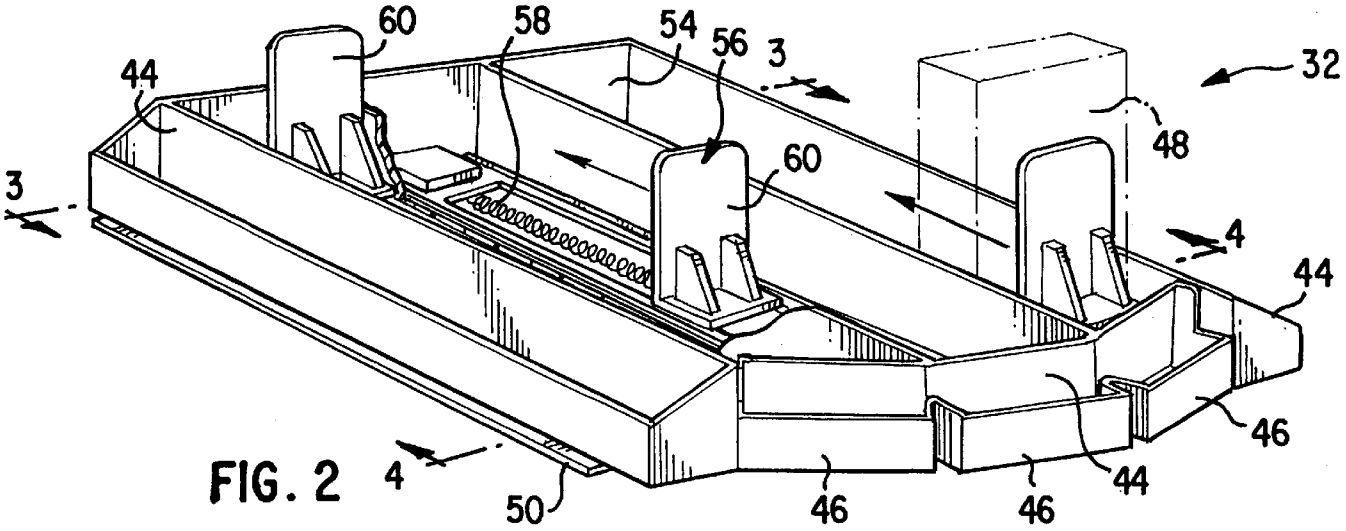
FIG. 2 is a perspective view of a shelf unit for the limited access sales apparatus of FIG. 1.
Figure 4:
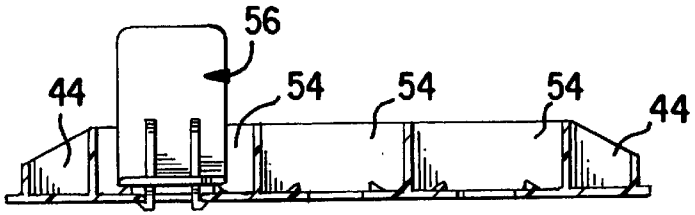
FIG. 4 is a cross-sectional view taken generally along the line 4—4 of FIG. 3.
Figure 3:
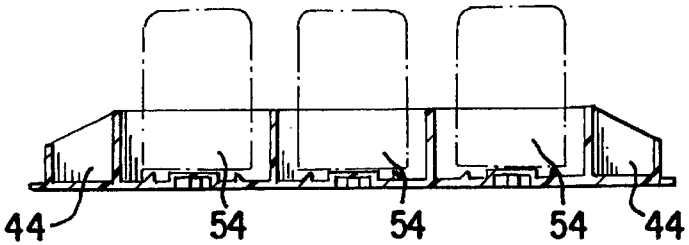
FIG. 3 is a cross-sectional view taken generally along the line 3—3 of FIG. 2.
Figure 5:
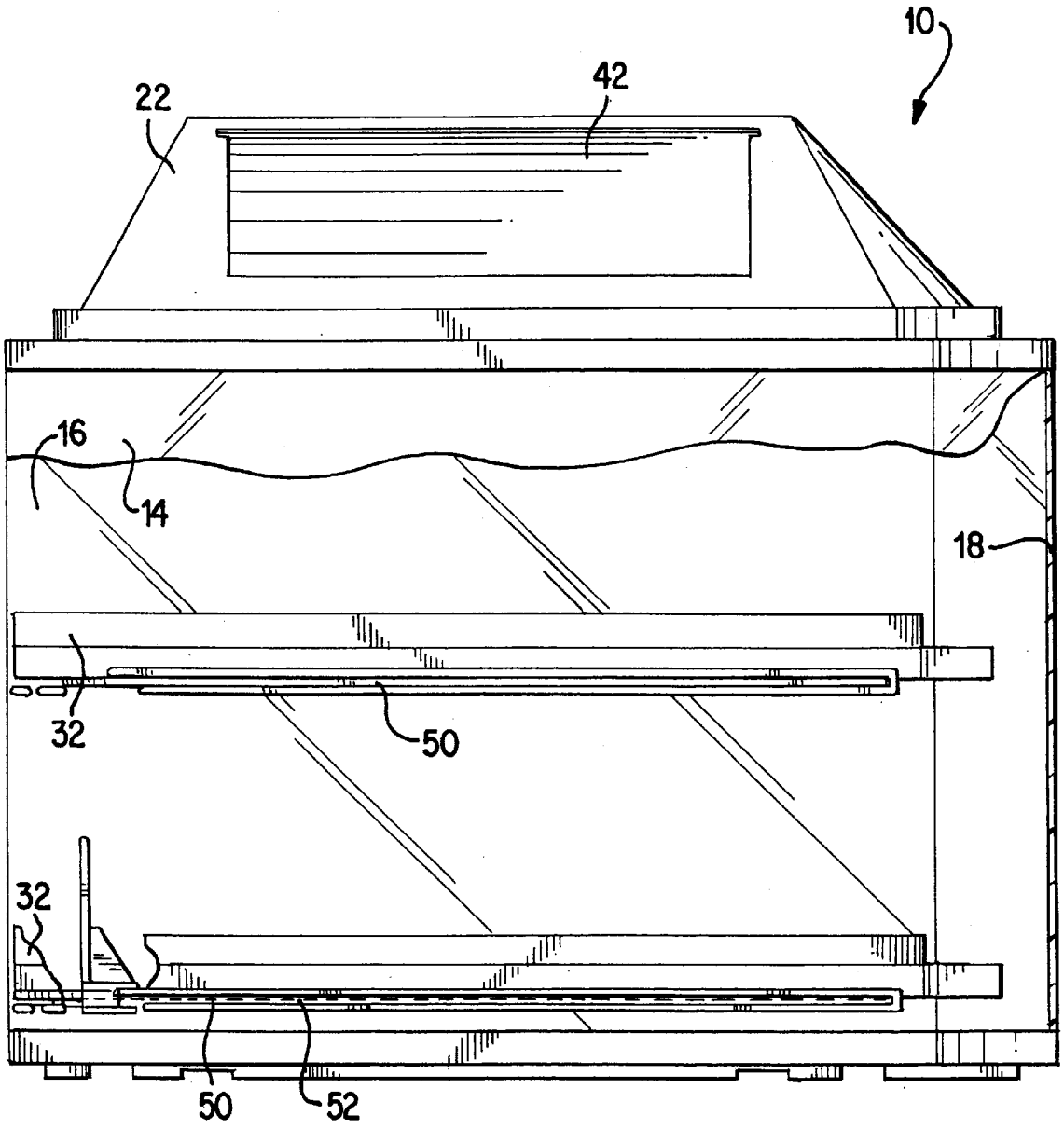
FIG. 5 is a side elevational view of the assembled limited access sales apparatus of FIG. 1 and the shelf unit FIG. 2, partially broken away for clarity.
Figure 6:
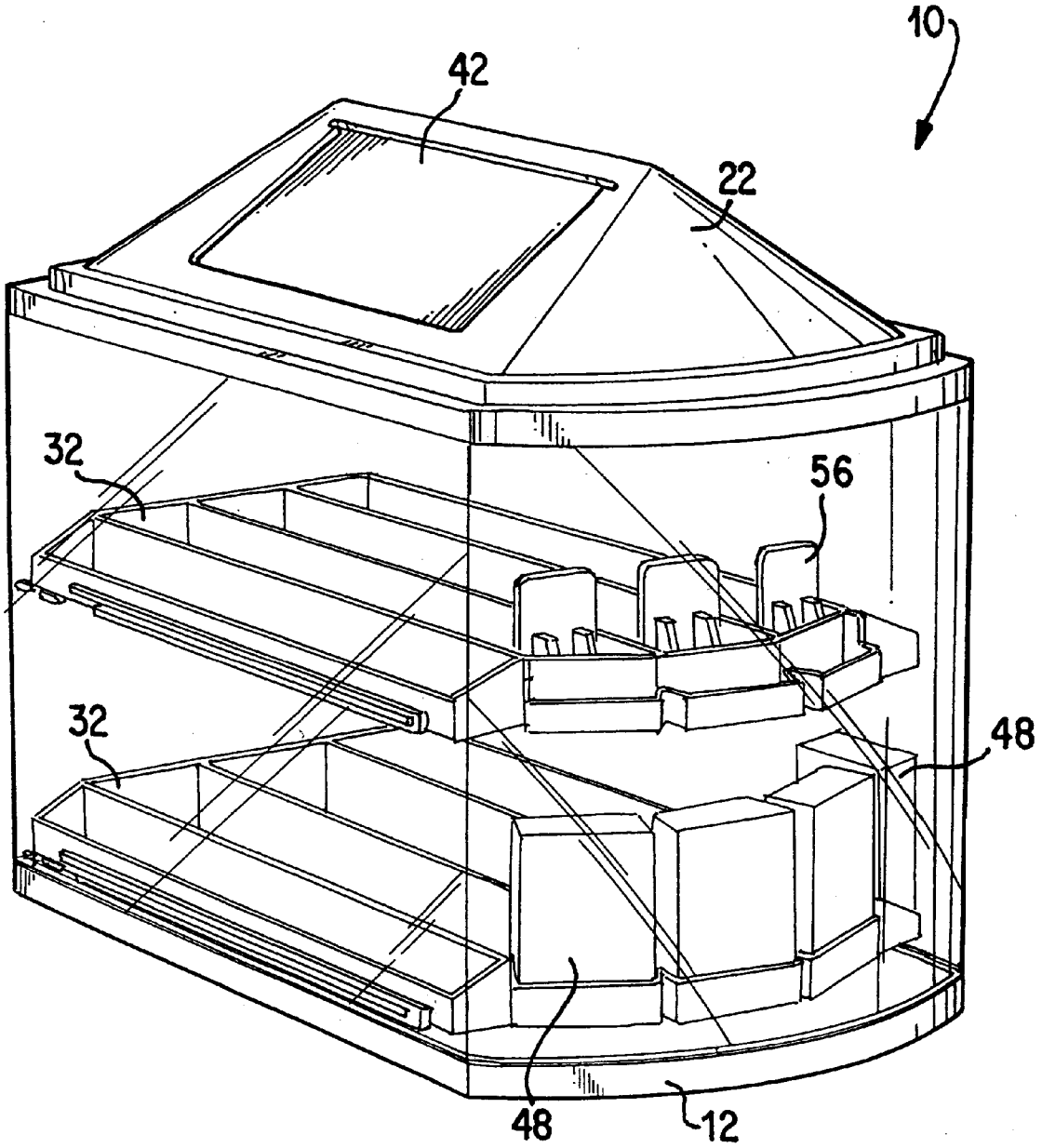
FIG. 6 is a perspective view thereof.

Referring to FIGS. 1 and 6, a sales apparatus according to the present invention is shown generally by reference numeral 10. Sales apparatus 10 includes a bottom support 12, opposing side walls 14, 16, a front wall 18, an upper support 20, and an upper cover element 22. The side walls and front wall of the sales apparatus are preferably made from a transparent plastic material having a sufficient strength and rigidity to withstand the demands of a sales apparatus. The walls may also be made of translucent or completely opaque material to obscure the contents of the apparatus from customer view. Suitable materials for the side walls and front wall include polyethylene terephthalate-G, polyvinyl chloride, and in particular, polyethylene terephthalate. A uniform wall thickness of approximately 2–10 mm, preferably 3–7 mm, most preferably about 4–5 mm for the side walls and the front wall is generally acceptable for use in the present invention. The use of a transparent material thereby encloses an interior region in which packages or cartons may be stored and displayed, as discussed further below. The sales apparatus 10 will generally be disposed on a countertop in a convenience store, drug store, or similar retail sales establishment. Thus, the rear portion or surface of the sales apparatus 10 is not enclosed by a rear wall, but remains open such that a store clerk will be able to easily access the packages therein and sell a requested item. By limiting access to only the rear surface, or another predetermined surface, the susceptibility of the packaged product to shoplifting is reduced. In addition, a more strict inventory control can be maintained since each package sold must be physically removed or dispensed by store personnel.

As shown in FIG. 1, the bottom support 12 includes a peripheral channel 24 into which the side walls 14, 16 and the front wall 18 are disposed. The peripheral channel 24 includes two linear channels extending along each side and a front curved channel, the curvature thereof corresponding to the curvature of the front wall 18. Although the illustrated embodiment shows a curved front wall 18 that may provide a more aesthetically pleasing display, it should be apparent to one skilled in the art that any configuration, planar or curved, could of course be used. The peripheral channel 24 also includes a plurality of lower retaining notches 26. The lowermost edges of the side walls 14, 16 and the front wall 18 include a plurality of lower retaining tabs 28, the lower retaining tabs 28 being lockingly engaged within the cooperating lower retaining notches 26 to thereby retain the sidewalls and front wall in a substantially upright position.

Each sidewall 14, 16 also includes a plurality of shelf supports 30 having a support groove 52 for removably supporting a storage and dispensing shelf 32, as described in greater detail below. A plurality of upper retaining tabs 34 are also disposed along the uppermost edges of the side walls 14, 16 and the front wall 18 to lockingly engage the side walls and the front wall with the upper support 20. A lower surface of the upper support 20 includes a plurality of upper retaining notches 36 for receiving the upper retaining tabs 34. An upper surface of the upper support 20 includes a peripheral channel 38 extending about the entire periphery thereof for receiving a lower edge of the upper cover element 22. The upper support 20, as illustrated, includes crossbraces which define a plurality of openings 40 therein. It should be apparent to one skilled in the art, however, that a solid upper support could of course also be used, as could any number and configuration of openings therein.

The preferred upper cover element 22 is generally trapezoidal in shape, resembling the style of a hip roof that is commonly used on homes. The upper cover element 22 may include a removable panel 42 for display of advertising materials or an identification of the product that is displayed for sale. Preferably, the panel is not removable and is not substantially coplanar to the ground. Thus, upper cover element 22 completes the enclosure of an interior region of the sales apparatus about all but one surface thereof. In this instance, the rear surface is intentionally left open for access to the interior region of the sales apparatus by store personnel. Although the sales apparatus of the present invention is shown having a generally rectangular shape with a bowed or curved front wall, it is within the scope of the present invention to construct the sales apparatus with any desired shape or curvature, provided that at least one surface thereof remains open to enable access to the interior region of the sales apparatus.

Referring also to FIGS. 2–5, the storage and dispensing shelf 32 is shown in greater detail. The term "display" applies in the event the housing is chosen to be transparent or substantially transparent. In the event the housing is not substantially transparent, the sales unit is more of a convenient storage unit than a display unit, but one of skill in the art will recognize the many uses of the article as an active transactional site storage container. The shelf 32 includes a lateral flange 50 extending from each side thereof. The flange 50 is removably engaged within the cooperating groove 52 of each shelf support 30 to thereby secure and support the shelf 32 in position. The shelf 32 also includes a storage row 44 on each side of the shelf 32 and extending along the front thereof. The storage rows 44 have a depth generally corresponding to the depth of the packaged product to be displayed or stored such that when the packaged product is disposed therein, the front display panel of the packaged product will be visible to consumers. If it is desired to display to customers a side of the packaged product other than the front panel, the width of the storage row 44 could of course be modified to allow the same. In the illustrated embodiment of the present invention, the storage row 44 extending along the front of the shelf 32 is defined by a plurality of individual pockets 46 which are angled appropriately to conform to the curvature of the front wall 18. As shown in FIG. 6, a package or carton 48 may be disposed in each of the pockets 46 and a plurality of the packages 48 may be adjacently aligned within each of the side storage rows 44 in order to present a neat and orderly display of the packaged product, such as cigarettes. Accordingly, the sales apparatus of the present invention offers all the merchandising capabilities of the prior art self-service display units, while also reducing the risk of theft.

Having thus described the sales or merchandising aspects of the storage and dispensing shelf 32, the dispensing aspects thereof will now be described in greater detail. Dispensing in this context preferably means to the sales personnel or persons with authorized access. As most clearly shown in FIG. 2, the storage and dispensing shelf 32 also includes a plurality of dispensing rows 54, the width of which substantially corresponds to the width of the packages to be dispensed. Each of the dispensing rows 54 has a dispensing mechanism 56, such as the illustrated pusher element 60 actuated by a spring 58, as known in the prior art. The dispensing mechanism 56 could of course be any other type of mechanism commonly utilized for sequentially dispensing packages or cartons. The dispensing mechanism may be made of plastic, metal or molded cardboard material, and the width thereof may be equal to or less than the width of the packages to be dispensed, as limited by the width of the dispensing row. Accordingly, a plurality of packages or cartons 48 are arranged within the rows 54 for dispensing or removal by store personnel. When disposed on a countertop or the like within a convenience store or other retail sales establishment, the dispensing rows 54 provide ready access for sales of the packaged product 48 by store personnel. In this manner, authorized salespersons are the only persons with access to product in the apparatus.

Figure 7:
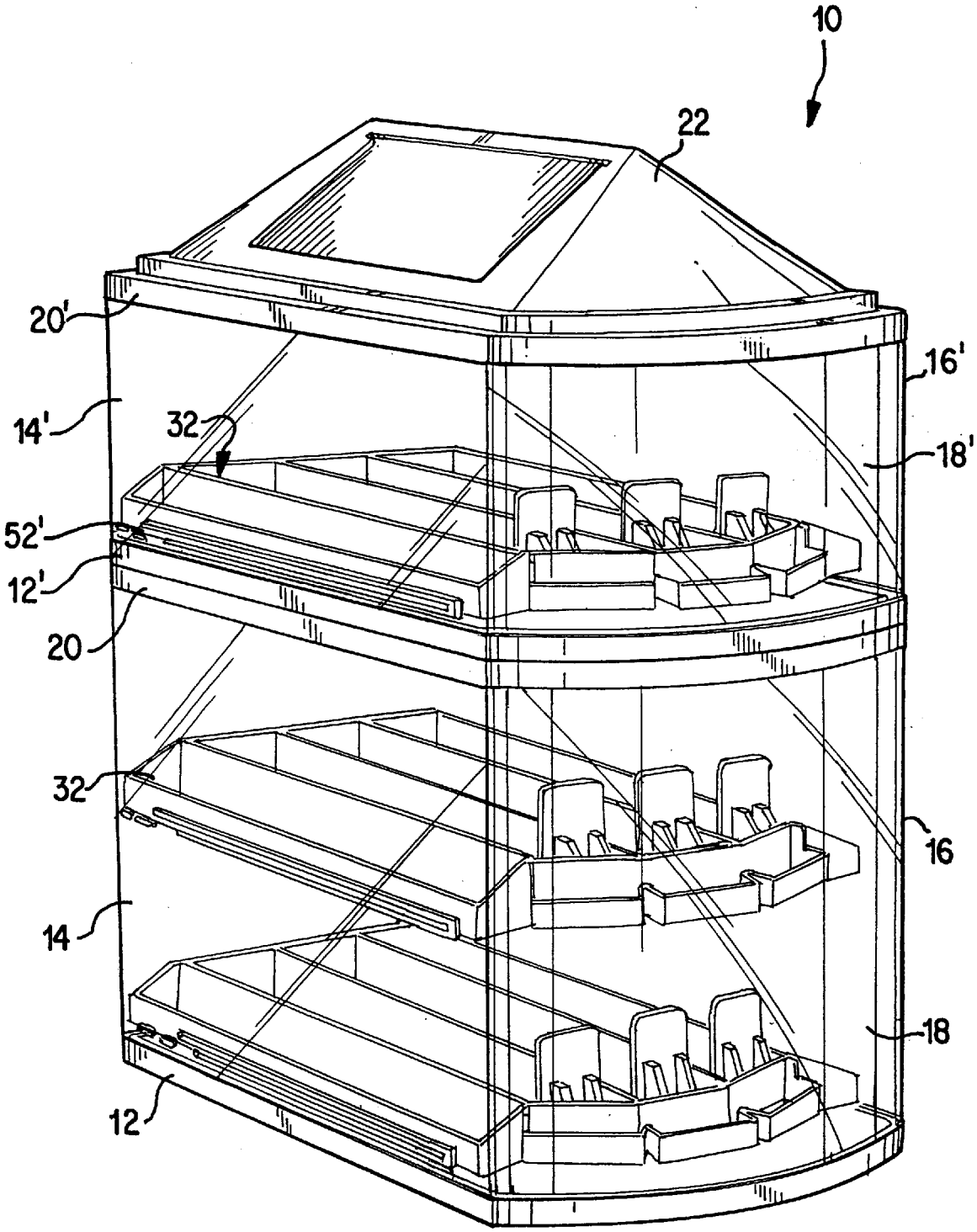
FIG. 7 is a perspective view of a further embodiment of the limited access sales apparatus of the present invention.

FIG. 7 illustrates a further embodiment of the present invention wherein sales apparatus 10' includes an additional storage and dispensing shelf 32 stacked above the side walls 14, 16. In order to further increase storage capacity as well as merchandising opportunities, sales apparatus 10' provides a further bottom support 12' disposed within the peripheral channel 38 of the upper support 20. Engaged within a peripheral channel (not shown) of the bottom support 12' are the side walls 14', 16' and the front wall 18', thereby defining an uppermost region of sales apparatus 10' and increasing the overall height thereof. It should be apparent to one skilled in the art that any number of shelf units may be vertically and horizontally stacked in order to increase the storage capacity of the sales apparatus of the present invention. A further upper support 20' is disposed above the side walls 14', 16' and the front wall 18', and the upper cover element 22 is then disposed thereabove.

An additional storage and dispensing shelf 32, preferably identical to shelf 32 described above, is disposed within the uppermost region of sales apparatus 10' by slidingly engaging the lateral flange 50 within the corresponding groove 52' on each of the side walls 14', 16'. Thus, store personnel are provided access to the uppermost region of the sales apparatus 10' in order to remove or dispense the packaged products therein.

Thus, as described above, the storage rows 44 of the sales apparatus 10 provide an aesthetically pleasing presentation for merchandising the packaged product for sale. At the same time, the dispensing rows 54 of the sales apparatus reduce the likelihood of shoplifting by limiting access to the packaged product disposed within the dispensing rows through the rear opening, which is intended to be used only by store personnel for sales. The present invention thereby provides the merchandising capabilities, ease and convenience of use generally associated with point of sale dispensing displays, while also achieving strict inventory and access control that is generally associated with lock and key displays and behind-the-counter stocking.

While the present invention has been described with preferred embodiments, it is to be understood that variations and modifications may be resorted to as will be apparent to those skilled in the art. Examples of such variations may include, for example, the number and size of the dispensing rows and the number and size of the storage rows. Other variations may include the number of access surfaces remaining open to provide store personnel with access to the displayed product. Further, the overall shape and dimension of the sales apparatus and the cover element therefor may easily be modified by one skilled in the art. Such variations and modifications are to be considered within the purview and the scope of the claims appended hereto.

We claim:

1. A sales apparatus for packages, comprising:

a bottom element including at least one storage shelf, said bottom element having a plurality of peripheral edges;

a plurality of side walls extending upwardly from said bottom element, ;

an upper element defining a top surface, said plurality of side walls joining said upper element such that said plurality of side walls and said upper element define an interior area of said sales apparatus;

wherein said at least one storage shelf includes a peripheral, non-dispensing, storage row adjacent to at least one of said side walls for displaying packages and at least one dispensing row disposed within an interior area of said storage shelf for dispensing packages.

2. The sales apparatus of claim 1 wherein said plurality of side walls includes opposing left and right side surfaces and a front surface.

3. The sales apparatus of claim 2 wherein said at least one peripheral storage row includes a first storage row adjacent to said left side surface, a second storage row adjacent to said right side surface, and a third storage row adjacent to said front surface.

4. The sales apparatus of claim 3 wherein said front surface is curved.

5. The sales apparatus of claim 4 wherein said third storage row includes a plurality of individual pockets angularly arranged to follow the curvature of said front surface.

6. The sales apparatus of claim 3 wherein said at least one dispensing row is disposed within a dispensing area defined by said first, second, and third display rows.

7. The sales apparatus of claim 6 wherein said at least one dispensing row comprises three dispensing rows.

8. The sales apparatus of claim 2 wherein said opposing left and right side surfaces define an access opening therebetween, said access opening providing user access to packages within said interior area.

9. The sales apparatus of claim 8 wherein said at least one dispensing row includes means for aligning a plurality of packages within said row and means for sequentially dispensing packages to a user through said access opening.

10. The sales apparatus of claim 1 wherein said plurality of side walls extend upwardly from said peripheral edges of said bottom element, said bottom element having a predetermined number of said peripheral edges and said plurality of side walls including a predetermined number of said side walls, said predetermined number of said peripheral edges being greater than said predetermined number of said side walls; said sales apparatus further comprising an access opening to said interior area, said access opening being defined by an opening between said plurality of side walls.

11. The sales apparatus of claim 1 wherein said at least one storage shelf includes a storage and dispensing shelf and said bottom element further includes a bottom support, said storage and dispensing shelf being lockingly engaged with at least two of said plurality of side walls.

12. The sales apparatus of claim 1 wherein said at least one storage shelf includes a plurality of storage shelves, a first one of said plurality of storage shelves including a bottom support member and a first storage and dispensing shelf lockingly engaged therewith.

13. The sales apparatus of claim 12 wherein a second one of said plurality of storage shelves includes a second storage and dispensing shelf supported between said plurality of side walls.

14. The sales apparatus of claim 1 wherein said bottom surface has a peripheral channel defined within at least some of said peripheral edges.

15. The sales apparatus of claim 14 wherein said peripheral channel includes retaining notches.

16. The sales apparatus of claim 15 wherein said side walls include retaining tabs, said retaining notches engaging said retaining tabs to secure said side walls in a vertical position.

17. The sales apparatus of claim 1 wherein said plurality of side walls are transparent.

18. The sales apparatus of claim 1 wherein said plurality of side walls are opaque.

19. The sales apparatus of claim 1 wherein said at least one storage shelf and plurality of side walls define a shelf unit, said shelf unit being stackable with an identical shelf unit disposed subjacent thereto.

20. The sales apparatus of claim 1 wherein said at least one dispensing row dispenses packages in a first orientation and said at least one peripheral, non-dispensing storage row stores the packages in a second orientation, said first orientation being different from said second orientation.

21. A storage and dispensing apparatus for packages, comprising:

a bottom support member;

a plurality of side walls extending upwardly from said bottom support member, at least two of said plurality of side walls including means for supporting a shelf;

at least one shelf supported by said supporting means for storing a plurality of packages;

an upper element defining a top surface, said plurality of side walls joining said upper element to define an enclosure about the plurality of packages;

wherein an access opening to the plurality of packages stored on said at least one shelf is defined between two of said plurality of side walls, said access opening providing a user with direct accessability to the plurality of packages in the enclosure and said at least one shelf includes a peripheral, non-dispensing, storage row adjacent to at least one of said side walls for displaying packages and at least one dispensing row disposed within an interior area of said shelf for dispensing packages.

22. A cigarette pack countertop sales fixture with limited access, comprising:

a bottom element including a plurality of peripheral edges and at least two storage shelves;

a plurality of side walls extending upwardly from said bottom element, said plurality of side walls defining an interior area of each said storage shelf;

an upper element defining a top surface, said plurality of side walls joining with said upper element;

wherein each said storage shelf includes peripheral, non-dispensing storage rows adjacent to said side walls for displaying cigarette packs;

said storage shelves further including dispensing rows within said interior area of said storage shelves for dispensing cigarette packs;

said side walls including opposing left and right side surfaces and a front surface; and wherein said peripheral storage rows include a first storage row adjacent to said left side surface, a second storage row adjacent to said right side surface, and a third storage row adjacent to said front surface;

wherein said third storage row includes a plurality of individual cigarette pack receptacle pockets arranged to follow the front surface;

said dispensing rows disposed within a dispensing area defined by said first, second and third storage rows;

wherein said dispensing rows comprise at least three dispensing rows;

wherein said opposing left and right side surfaces are adapted to define a rear access opening therebetween, said rear access opening providing user access from a rear direction to cigarette packs within said interior area;

wherein the dispensing rows include means for aligning a plurality of cigarette packs within said rows and means for sequentially dispensing cigarette packs to a user through said access opening; and wherein said bottom element further includes a bottom support member and at least one said storage shelf includes a storage and dispensing shelf lockingly engaged with said side walls to limit access to said cigarette pack countertop sales fixture, said plurality of side walls extending upwardly from said bottom support member.

23. The countertop sales fixture of claim 22 further comprising a third storage shelf having a bottom surface, including a plurality of peripheral edges.

24. The countertop sales fixture of claim 23 wherein said plurality of side walls are formed from a substantially transparent rigid material such that cigarette packs within the display rows and within said interior area are visible.

25. The countertop sales fixture of claim 22 wherein said upper element is formed from a rigid material, said upper element including a removable panel for displaying desired information.

26. The countertop sales fixture of claim 22 wherein said dispensing rows dispense cigarette packs in a first orientation and at least one of said peripheral, non-dispensing storage rows store cigarette packs in a second orientation, said first orientation being different from said second orientation.

* * * * *